US012796829B2

(12) United States Patent
Torosian et al.

(10) Patent No.: US 12,796,829 B2
(45) Date of Patent: Nov. 17, 2026

(54) PORTABLE CRIB WITH FEET HAVING RECEPTACLES FOR REMOVABLY RECEIVING STRUCTURAL COMPONENTS OF THE CRIB

(71) Applicant: Baby Delight, Inc., Cumberland, RI (US)

(72) Inventors: Steve Torosian, York, ME (US); Jason P. Macari, Cumberland, RI (US)

(73) Assignee: Baby Delight, Inc., Cumberland, RI (US)

( * ) Notice: Subject to any disclaimer, the term of this patent is extended or adjusted under 35 U.S.C. 154(b) by 0 days.

(21) Appl. No.: 19/190,910

(22) Filed: Apr. 28, 2025

(65) Prior Publication Data

US 2025/0331655 A1 Oct. 30, 2025

Related U.S. Application Data

(60) Provisional application No. 63/639,976, filed on Apr. 29, 2024.

(51) Int. Cl.
*A47D 7/00* (2006.01)

(52) U.S. Cl.
CPC ..... *A47D 7/005* (2013.01); *A47D 7/002* (2013.01)

(58) Field of Classification Search
CPC ..... A47D 7/005; A47D 7/002; A47D 13/063; A47D 13/06; A47D 13/061; A47D 9/016; A47D 13/066; A47D 9/005; A47D 11/005
See application file for complete search history.

(56) References Cited

U.S. PATENT DOCUMENTS

| | | | | |
|---|---|---|---|---|
| 2,698,443 | A * | 1/1955 | Ralick | A47D 7/002 5/98.1 |
| 4,811,437 | A * | 3/1989 | Dillner | A47D 13/063 5/99.1 |
| 5,533,215 | A | 7/1996 | Malofsky et al. | |
| 5,956,786 | A * | 9/1999 | Huang | A47D 13/06 403/329 |
| 6,510,568 | B1 | 1/2003 | Drobinski et al. | |
| 12,502,010 | B1 * | 12/2025 | Bickel | A47D 13/063 |

(Continued)

OTHER PUBLICATIONS

PCT Search Report and Written Opinion mailed Jul. 2, 2025, received in corresponding PCT Application No. PCT/US2025/026583, 8 pages.

*Primary Examiner* — Madison Matthews
(74) *Attorney, Agent, or Firm* — Secant IP, PLLC

(57) ABSTRACT

A portable crib including four feet and four side rails. Each of the feet has a first receptacle, a second receptacle and a third receptacle, the first, second and third receptacles being arranged adjacent different associated corners thereof. Each of the four side rails has a straight portion and first and second angled ends configured to extend downwardly into the first receptacle or the second receptacle of different associated ones of the four feet to allow each of the four side rails to be removably received in the different associated ones of the four feet by inserting the first and second angle ends downwardly and into the first receptacle or the second receptacle of the different associated ones of the four feet. Four vertical posts are configured to be removably received within the third receptacle of different associated one of the four feet.

20 Claims, 5 Drawing Sheets

(56) References Cited

U.S. PATENT DOCUMENTS

| | | | | |
|---|---|---|---|---|
| 2004/0064887 | A1* | 4/2004 | Cheng | A47D 13/063 5/310 |
| 2009/0144896 | A1 | 6/2009 | Chen et al. | |
| 2021/0274946 | A1* | 9/2021 | Torosian | A47D 13/06 |
| 2024/0074597 | A1 | 3/2024 | Torosian et al. | |

* cited by examiner

PORTABLE CRIB WITH FEET HAVING RECEPTACLES FOR REMOVABLY RECEIVING STRUCTURAL COMPONENTS OF THE CRIB

CROSS-REFERENCE TO RELATED APPLICATIONS

The present application claims the benefit of the filing date of U.S. Provisional Application Ser. No. 63/639,976, filed Apr. 29, 2024, the teachings of which are hereby fully incorporated herein by reference.

TECHNICAL FIELD

The present disclosure relates to portable crib, and, in particular, to a portable crib with feet having receptacles for removably receiving structural components of the crib.

BACKGROUND INFORMATION

Cribs are traditionally cumbersome to set up and are often not easy to move from room to room once set up. A crib may include structural components, such as side rails, end rails, posts, etc., that are assembled to form an interior space for receiving a mattress, e.g. a full-sized mattress. Some portable cribs are configured to allow for facile assembly and provide a stable configuration for supporting the mattress. One example of such a portable crib is shown and described in U.S. Pat. No. 12,150,562, the teachings of which are hereby incorporated herein by reference.

BRIEF DESCRIPTION OF THE DRAWINGS

For a better understanding of the present invention, together with other objects, features and advantages, reference should be made to the following detailed description which should be read in conjunction with the accompanying figures, wherein.

DETAILED DESCRIPTION

Figure 1:
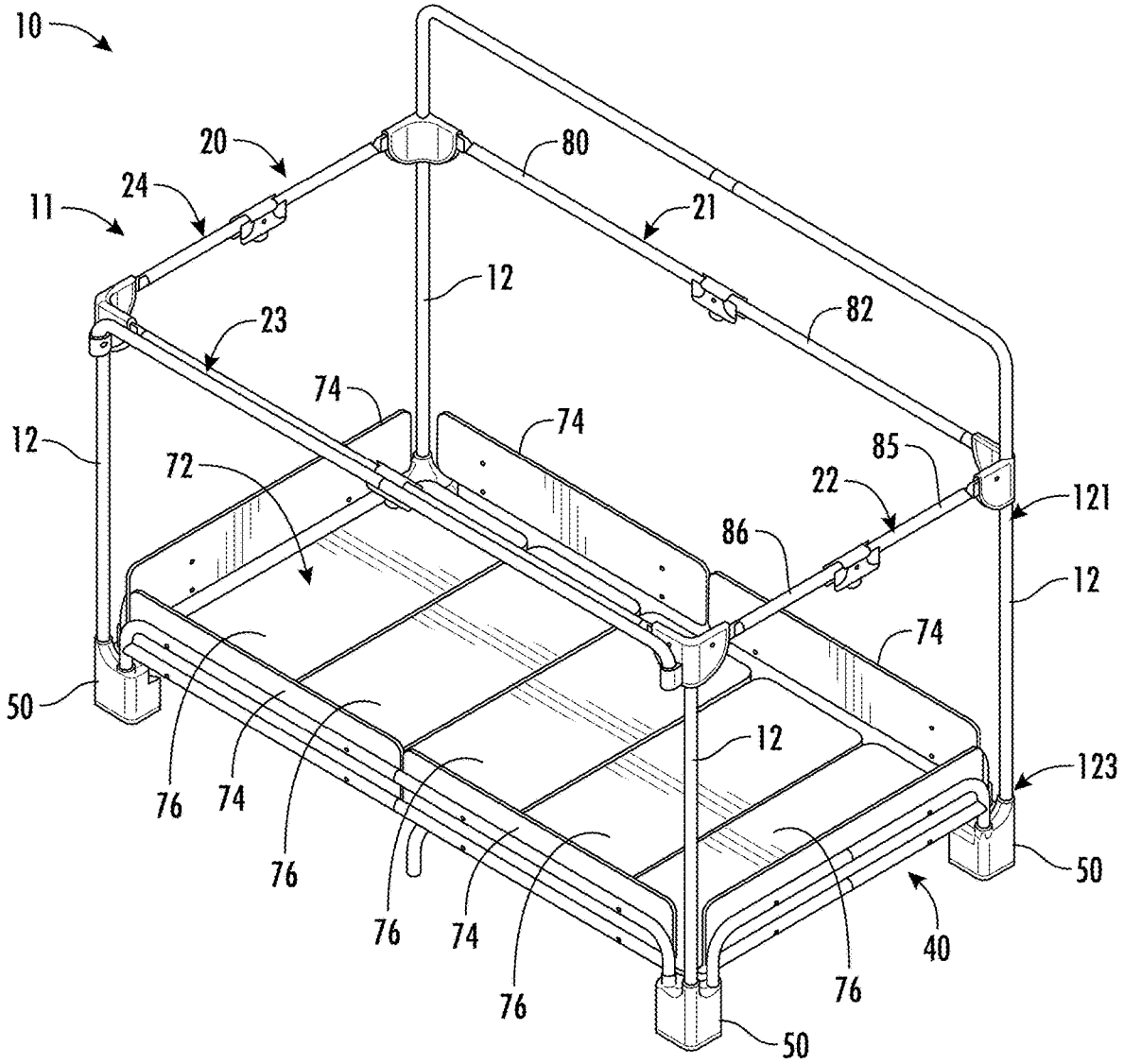
FIG. 1 is a perspective view of one example embodiment of a portable crib consistent with the present disclosure.

The present disclosure is not limited in its application to the details of construction and the arrangement of components set forth in the following description or illustrated in the drawings. The examples described herein may be capable of other embodiments and of being practiced or being carried out in various ways. Also, the phraseology and terminology used herein is for the purpose of description and should not be regarded as limiting as such may be understood by one of skill in the art. Throughout the present description, like reference characters may indicate like structure throughout the several views, and such structure need not be separately discussed. Furthermore, any particular feature(s) of a particular exemplary embodiment may be equally applied to any other exemplary embodiment(s) of this specification as suitable. In other words, features between the various exemplary embodiments described herein are interchangeable, and not exclusive.

In some embodiments, a portable crib consistent with the present disclosure includes an in-use configuration whereby the same can support a mattress and provide a safe sleeping environment for infants. In addition, portable cribs consistent with the present disclosure include a storage configuration for storage and/or travel and may be transitioned from the in-use configured to the storage configuration based on folding/collapsible frame members. This may be facilitated, for example, by use of feet with receptacles therein removably receiving structural components of the portable crib, e.g. side rails, end rails, posts, etc. during assembly of the portable crib to place the crib in the in-use configuration. To transition the crib to the storage configuration, the structural components may be withdrawn upwardly out of the receptacles.

In some embodiments, a portable crib consistent with the present disclosure be configured to accept and support a full-size crib mattress and, in some embodiments, surround the mattress with breathable mesh panels. In some cases, the size of cribs (and supporting frames) is mandated by standards such as ASTM F1169. In addition, mattress sizes are also mandated in some cases. A full size crib mattress may be defined by applicable mattress standards as: 27¼ inches× 51¼ inches, with a thickness not exceeding 6 inches.

Such mandates generally seek to limit the maximum allowed gap that exists between the edge of a mattress and the frame defining the crib walls. Thus, in accordance with some embodiments, a portable crib consistent with the present disclosure may include a frame for supporting a full size mattress in a manner that meets applicable standards regarding the maximum gap between the mattress and the frame, such as ASTM F1169.

FIGS. 1-7 illustrate one example embodiment of a portable crib 10 consistent with the present disclosure. FIG. 1 is a perspective view of the crib 10 including a frame 11, a base 72 supported on the frame 11, and side boards 74 at an interior of the frame 11. In general, a mattress (not shown), e.g., a full-size crib mattress, may be placed on top of the base 72 with the side boards 74 extending around the perimeter of the mattress. The dimensions of the frame may leave a gap between the mattress and the side boards that meets the applicable standards regarding the same, such as ASTM F1169. The base 72 and the side boards 74 may be constructed from a rigid material, such as medium-density fiberboard (MDF). The base 72 may include a plurality of base segments 76, as shown, or may be a single rigid piece.

Figure 2:
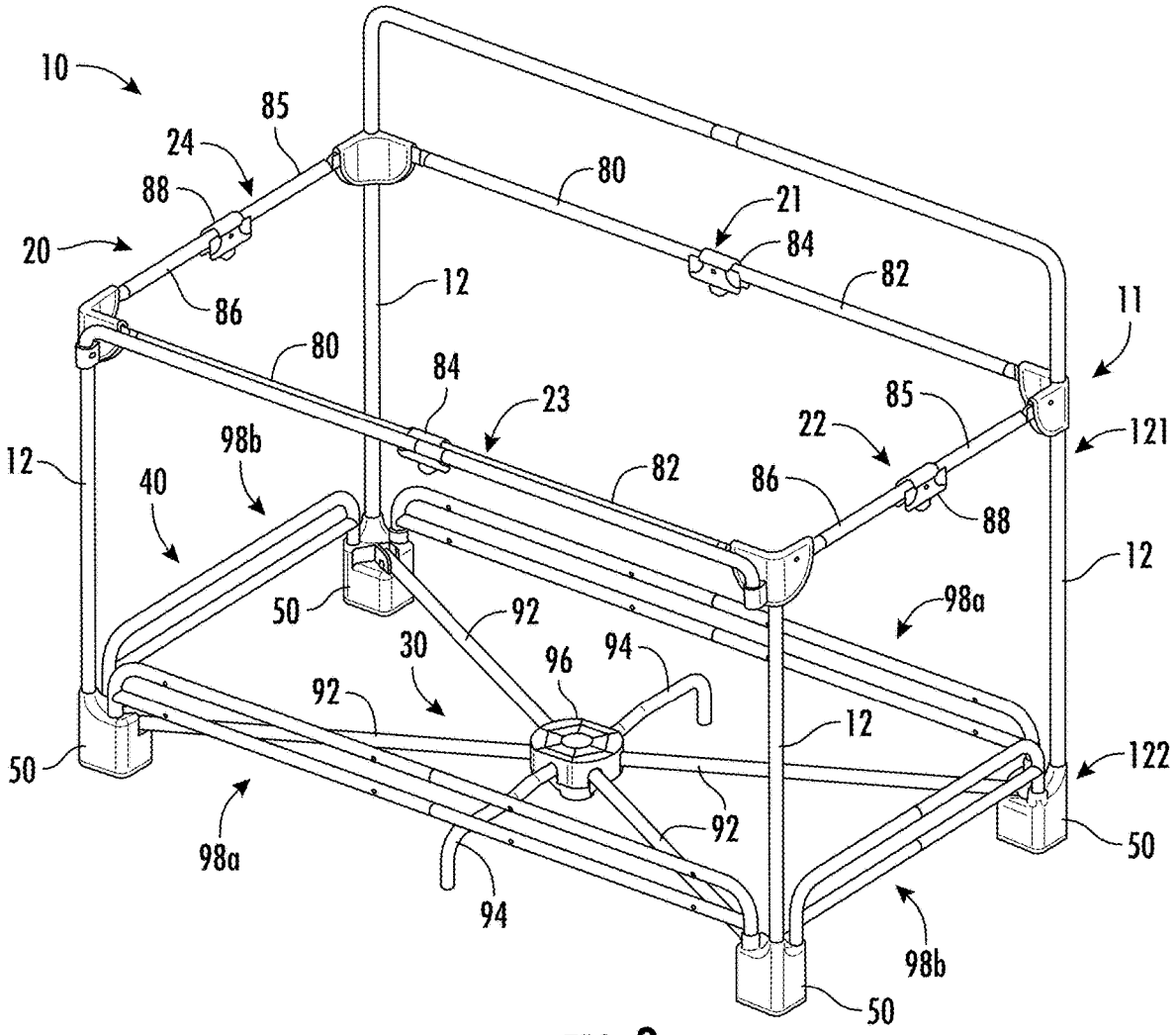
FIG. 2 is a perspective view of the portable crib shown in FIG. 1 with the base and side boards removed.
Figure 3:
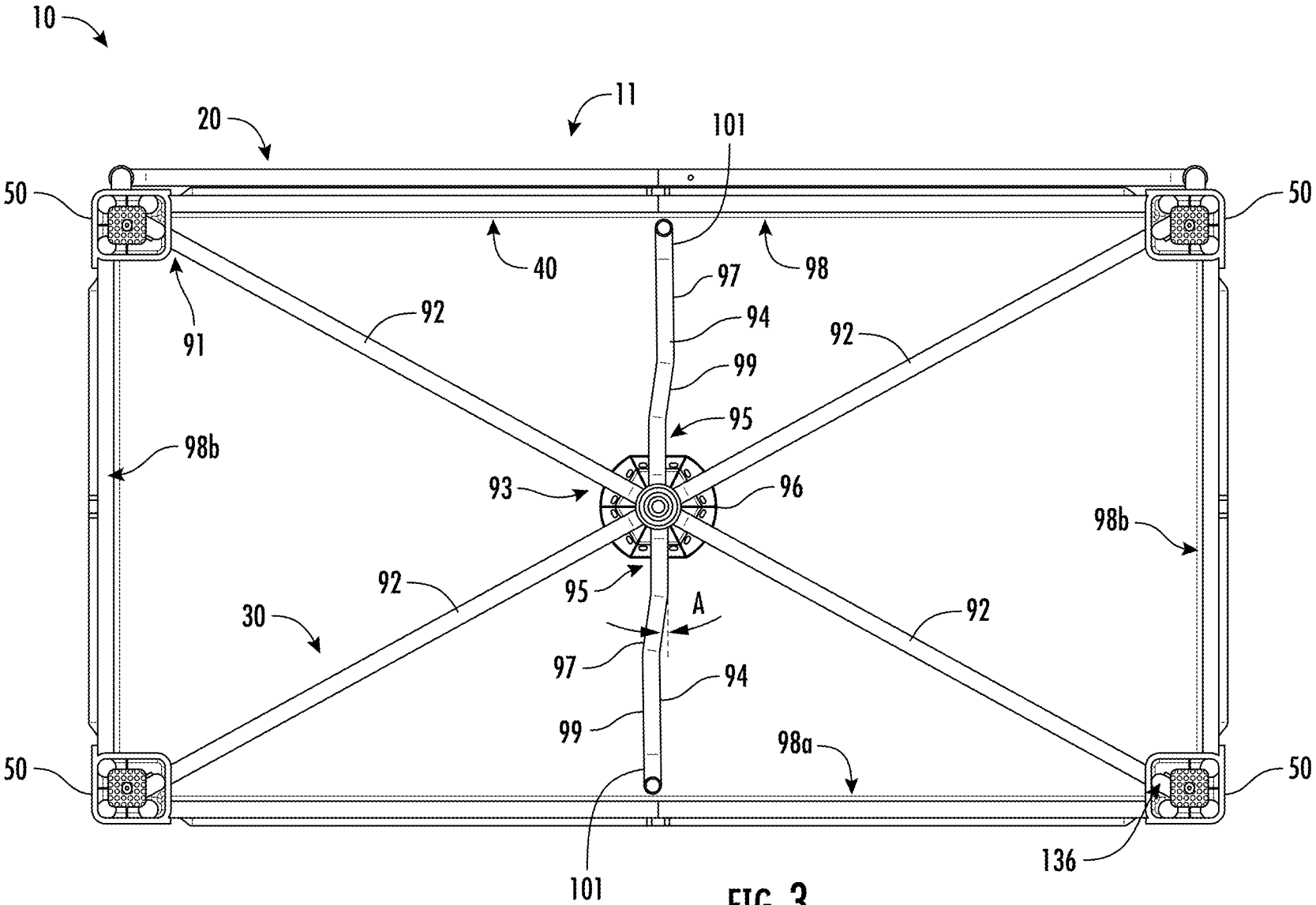
FIG. 3 is a bottom view of the portable crib shown in FIG. 1 with the base and side boards removed.

FIG. 2 is a perspective view of the frame 11 shown in FIG. 1 and FIG. 3 is a bottom view of the frame 11 shown in FIG. 1. The frame 11 includes a collapsible top assembly 20, a bottom assembly 30, and a perimeter frame 40 positioned for extending around the perimeter of the mattress. As shown, the frame 11 includes four vertical posts 12. Each post has an upper end 121 and lower end 123. The lower end 123 of each post 12 is plugged/snapped into associated one of four feet 50.

In the illustrated example embodiment, the collapsible top assembly 20 includes long top rail 21 and 23, and short top rails 22 and 24. Each long top rail 21, 23 includes first 80 and second 82 rail members. Each first rail member 80 is pivotally connected to a second rail member 82, e.g., via a hinge 84, to collectively provide a long top rail 21, 23. Each long top rail 21, 23 has one end pivotally connected to an upper end 121 of a first vertical post 12 and another end pivotally connected to an upper end 121 of a second vertical post 12. Each short top rail 22,24 includes first 85 and second 86 rail members. Each first rail member 85 is pivotally connected to a second rail member 86, e.g., via a hinge 88, to collectively provide a short top rail 22, 24. Each short top rail 22, 24 has one end pivotally connected to an upper end 121 of a first vertical post 12 and another end pivotally connected to an upper end 121 of a second vertical post 12. In the illustrated example embodiment, connection of the long top rails 21, 23 and the short top rails 22, 24 to the vertical posts 12 defines a rectangular upper perimeter of the portable crib that is collapsible via the hinges 84 and 88 and the pivotal connection of the long top rails 21, 23 and the short top rails, 22, 24 to the vertical posts 12.

The bottom assembly 30 includes four bottom rail members 92, two support legs 94, and a hub 96. With reference also to FIG. 3, each of the bottom rail members 92 has a first end 91 removably coupled an associated one of the four feet 50, and a second end 93 coupled to the hub 96. Each of the support legs 94 has a first end 95 coupled to the hub 96, an angled portion 97, an extension 99, and second end 101. The angled portion extends at a non-zero angle A from an end of first end 95 and is coupled to the extension 99 to offset the extension 99 with respect to the first end 95. The second end 101 is coupled to an end of the extension 99 extends downwardly at an angle, e.g. substantially a right angle, to the extension 99 to contact a floor surface on which the portable crib 10 rests. The offset provided by the angled portion 97 substantially centers the contact between second end 101 and the floor surface between vertical posts 12 on a long side of the portable crib. The bottom rail members 92 and the support legs 94 are configured to underlie and support a mattress, e.g., a full-size mattress.

The perimeter frame 40 includes two long side rails 98*a*, and two short side rails 98*b*. Each side rail 98*a*, 98*b* of the perimeter frame 40 may be configured as a steel tube. With reference also to the cross-sectional views of FIGS. 6 and 7, each of the side rails 98*a* includes an upper rail 100*a* and a lower rail 102*a*, and each of the upper rails 100*a* and the lower rails 102*a* includes a first rail member 104*a* and a second rail member 106*a*. Each of the side rails 98*b* includes an upper rail 100*b* and a lower rail 102*b*, and each of the upper rails 100*b* and the lower rails 102*b* includes a first rail member 104*b* and a second rail member 106*b*.

The first 104*a* and second 106*a* rail members and the first 104*a* and second 104*b* rail members may have a straight ends that are removably coupled to each other. The upper 100*a* and lower 102*a* rails and the upper 100*b* and lower 102*b* rails meet at a common angled end 108*a*, 108*b*, respectively, that is angled downwardly with respect to the straight ends, e.g., at substantially a right-angle. In some embodiments, the angled ends 108*a*, 108*b* may be removable from the first 104*a*, 104*b* second 106*a*, 106*b* rail members of the upper 100*a*, 100*b* and lower 102*a*, 102*b* rails, respectively. The angled ends 108*a*, 108*b* may be removable coupled to feet 50. The perimeter frame 40 may be sized to encompass a full size baby crib dimensions and extend around a perimeter thereof. In some embodiments, the perimeter frame may, for example, define an interior dimension of 28"+-⅝" wide and 52-⅜"+-⅝" long.

Figure 4:
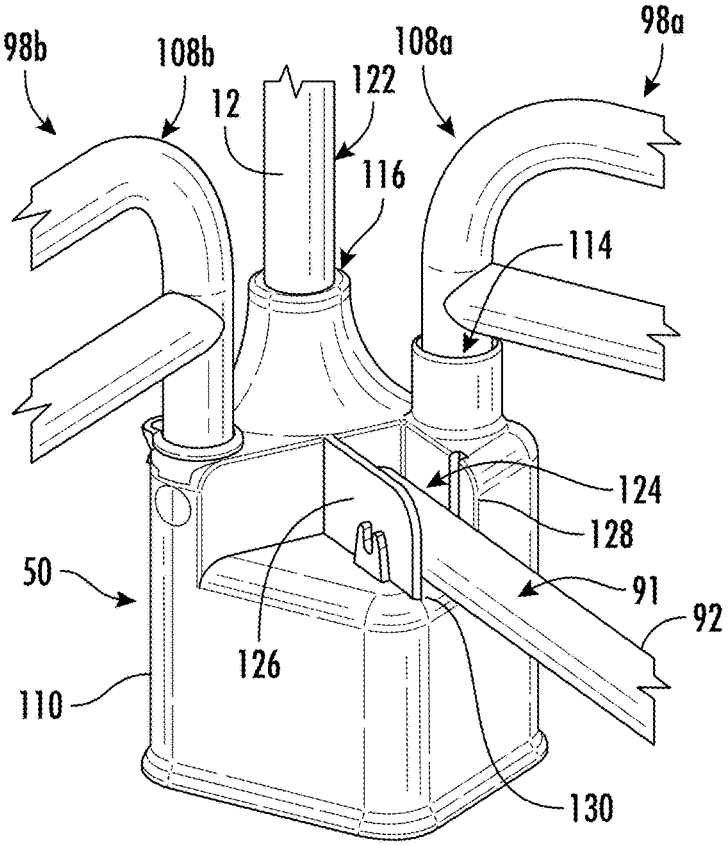
FIG. 4 is a perspective view of a foot and a portion of the frame of the portable crib shown in FIG. 1.
Figure 5:
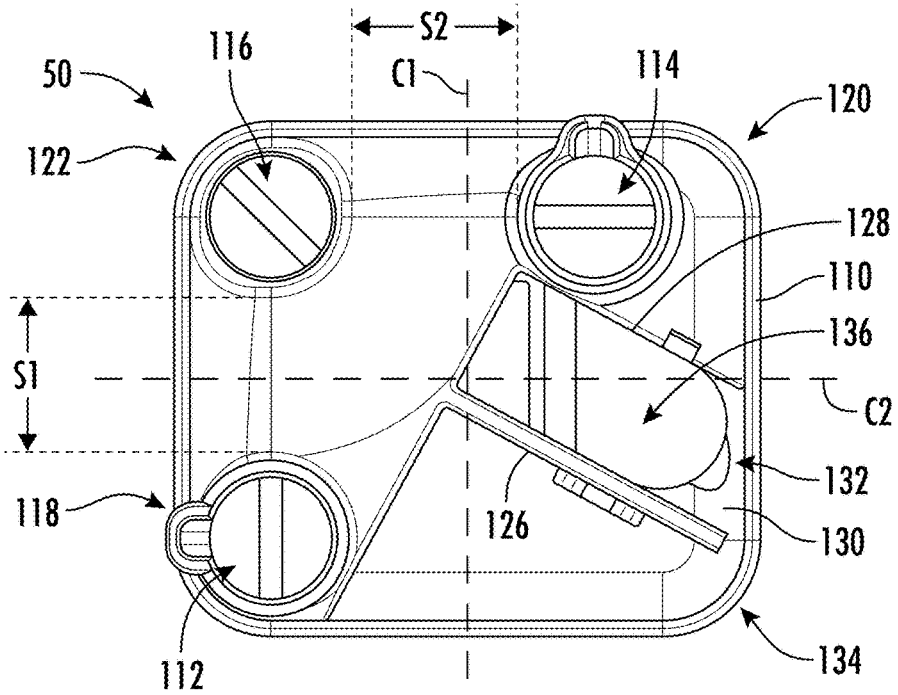
FIG. 5 is a top view of the foot shown in FIG. 4.

The feet for use in connection with a portable crib consistent with the present disclosure may be provided in a variety of configurations. FIG. 4 is a perspective view of a portion of the frame 11 shown in FIG. 2 showing one of the feet 50 in detail. FIG. 5 is a top view of the foot 50 shown in FIG. 4. The feet 50 may be injection molded from polypropylene with added stiffening agent, e.g., talc or thereof equivalent.

As shown in FIGS. 4 and 5, each of the feet 50 has a base 110. Although the base 110 in the illustrated example embodiment has a parallelogram-shaped cross-section, it is to be understood that the feet in a portable crib consistent with the present disclosure are not limited to feet having a parallelogram-shaped cross-section. Indeed, the feet may have a cross-section of any regular or irregular geometric shape, and the feet of a portable crib consistent with the present disclosure may have different associated cross-sectional shapes.

The bottom of the base 110 is generally flat and configured to rest on a floor surface. Each foot 50 also includes a first receptacle 112, a second receptacle 114, and a third receptacle 116. The first 112, second 114 and third 116 receptacles are defined by openings that extend downwardly into the base 110 and are arranged adjacent different associated corners 118, 120, 122, respectively, of the base 110. The corners 118, 120, 122 are defined at the perimeter of the base 110.

With reference to FIG. 5, for example, the first receptacle 112 is positioned adjacent a first corner 118 of the of the base 110, the second receptacle 114 is positioned adjacent a second corner 120 of the base 110, and the third receptacle 116 is disposed between the first 112 and second receptacles 114 and positioned adjacent a third corner 122 of the base 110. As used herein, a receptacle 112, 114, 116 is adjacent to a corner 118, 120, 122, respectively, when at least a portion of the receptacle 112, 114, 116 is between a corner 118, 120, 122, respectively and a centerline C1 or C2 of the base extending through a center point of the base 110 and perpendicularly to a side of the base 110. In some embodiments, the entirety of one or more of the receptacles 112, 114, 116 is between an associated corner 118, 120, 122, respectively, and a centerline C1 or C2 of the base 110. In the illustrated example embodiment, the entirety of each of the receptacles 112, 114, 116 is between an associated corner 118, 120, 122, respectively, and a centerline C1 or C2 of the base 110.

A space S1 is thus formed between the perimeter of first receptacle 112 and the perimeter of the third receptacle 116 and a space S2 is formed between the perimeter of the second receptacle 114 and the perimeter of the third receptacle 116. In some embodiments, the spaces S1 and S2 may be 1 inch or greater, or 0.5 inches or greater, and in some embodiments the space may be about 2 inches+/10%. Advantageously, the space S1, S2 between the receptacles allows for facile assembly and disassembly of the post and rails to the foot 50 by providing room for a user to grasp the angled ends 108 of the side rails 98.

As shown, each of the feet 50 also includes a fourth receptacle 124 for receiving an end 91 of an associated one of the bottom rail members 92. In the illustrated example embodiment, the fourth receptacle 124 is defined by first 126 and second 128 spaced and upwardly extending walls and the top surface 130 of a shelf defined by the base 110. The fourth receptacle 124 has an open end 132 adjacent a fourth corner 134 of the base 110. A bottom of the fourth receptacle 124 between the first 126 and second 128 spaced walls may open into an interior cavity 136 defined by the base 110.

As shown in FIG. 4, with respect to each of the feet 50 an angled end 108*b* of a short side rail 98*b* is inserted downwardly into the first receptacle 112, an angled end 108*a* of a long rail side rail 98*a* is inserted downwardly into the second receptacle 114, and a lower end 123 of a post 12 is inserted downwardly into the third receptacle 116. An end 91 of bottom rail member 92 may be inserted into the fourth receptacle 124 and removably fixed thereto. When the portable crib 110 is assembled, the angled ends 108*a*, 108*b* of each of the four side rails 98*a*, 98*b* extends downwardly into the first receptacle 112 or the second receptacle 114 of different associated ones of the four feet 50 to allow each of the four side rails 98*a*, 98*b* to be removably received in the different associated ones of the four feet 50. Also, each of the four posts 12 is removably received in the third receptacle 116 different associated one of the four feet 50, and an associated one of bottom rails 92 is removably received in the fourth receptacle 124 of the four feet 50. The side rails 98*a*, 98*b*, the posts 12, and or the bottom rail members 92 may be removably coupled the associated receptacle 112, 114, 116, 124 by a pin, e.g. a spring biased pin, to allow for facile connection and disconnection to the foot 50.

Figure 6:
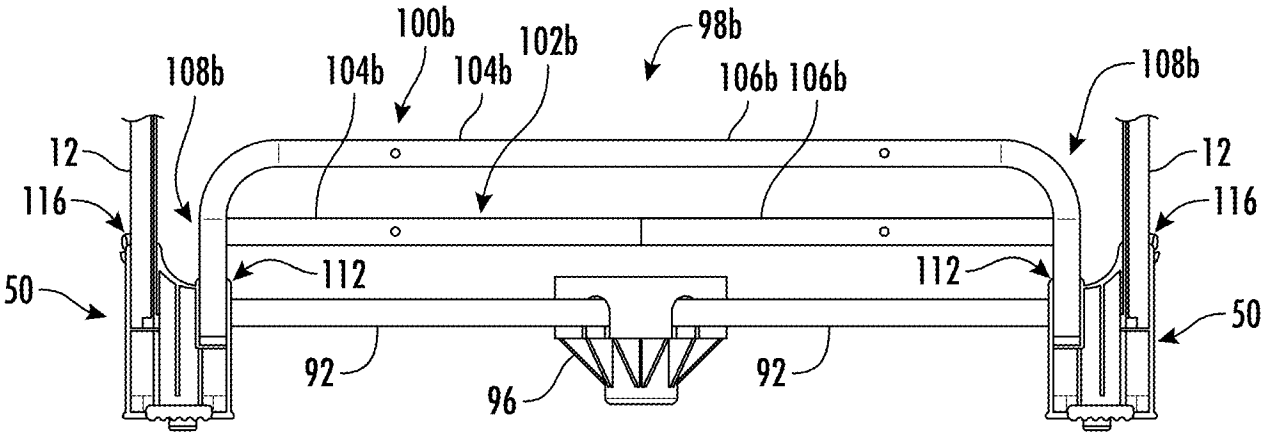
FIG. 6 is a width-wise cross-sectional view of the portable crib shown in FIG. 1 with the base and side boards removed.
Figure 7:
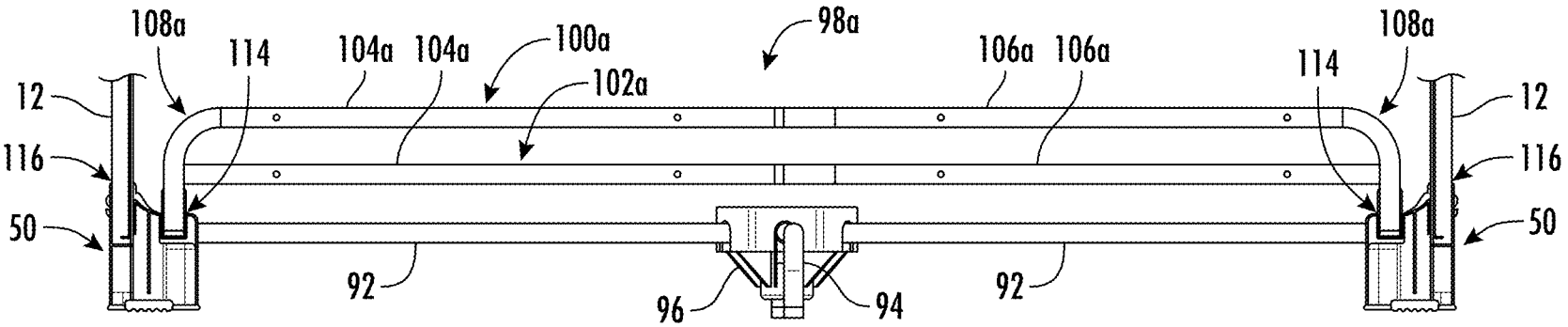
FIG. 7 is a length-wise cross-sectional view of the portable crib shown in FIG. 1 with the base and side boards removed.

FIG. 6 is a cross-sectional view of a portion of frame 11 showing connection of the posts 12 and a short side rail 98*b* to first and second ones of the feet 50. As shown, the angled ends 108*b* of the short side rail 98*b* are inserted into the first receptacles 112 of associated ones of the feet 50 and lower ends 123 of the posts 12 are inserted into the third receptacles 116 of the associated feet 50. FIG. 7 is a cross-sectional view of a portion of the frame 11 showing connection of the posts 12 and a long side rail 98*a* to first and second ones of the feet 50. As shown, the angled ends 108*a* of the long side rail 98*a* are inserted into the second receptacles 114 of associated ones of the feet 50 and lower ends 123 of the posts 12 are inserted into the third receptacles 116 of the associated feet 50. A first end 91 of a bottom rail member 92 is disposed in a fourth receptacle 124 of each of the feet 50 and a second end 93 of the bottom rail member 92 is removably coupled to the hub 96.

In some embodiments, a portable crib 10 consistent with the present disclosure may be provided to a user with the top assembly 20 and the bottom assembly 30 in a pre-assembled and folded configuration and coupled to posts 12 and the feet 50. For example, the top assembly 20 may be coupled to the posts 12 and folded at the hinges 84 and 88 and the pivoting connections to the posts, the lower ends 123 of the posts 12 may be disposed in the third receptacles 116 of the feet 50, the hub 96 may be extended upwardly with second ends 93 of the bottom rail members 92 folded at their pivoting at their connection to the hub and the first ends 91 of the bottom rail members folded their connection the fourth receptacles 124 of the feet 50, and the support legs 94 folded at their pivoting connection to the hub 96.

The components of the perimeter frame 40 may not initially be coupled to the top assembly 20, the bottom assembly 30 and the feet 50. A user may assemble the crib by unfolding the top assembly 20 and forcing the hub 96 downwardly toward the floor. The user may then assemble the long side rails 98*a* and the short side rails 98*b* and insert the angled ends 108*b* of the short side rails 98*b* into the first receptacles 112 of the feet 50 and insert the angled ends 108*a* of the long side rails 98*a* into the second receptacles 114 of the feet 50. The user may then place the base 72 on top of the bottom rail members 92 and the support legs 84 and place the side boards 74 around the perimeter of the base. The mattress may then be placed on top of the base 72 with the side boards 74 extending around the perimeter of the mattress. The side walls of the frame 11 may then be covered by a mesh fabric to enclose the interior space defined by the frame 11.

In accordance with another aspect of the disclosure there is provide a portable crib including: four feet, each of the four feet including a first receptacle, a second receptacle and a third receptacle, the first, second and third receptacles being arranged adjacent different associated corners thereof; four side rails, each of the four side rails including a straight portion and first and second angled ends positioned at an angle to the straight portion, the first and second angled ends configured to extend downwardly into the first receptacle or the second receptacle of different associated ones of the four feet to allow each of the four side rails to be removably received in the different associated ones of the four feet by inserting the first and second angle ends downwardly and into the first receptacle or the second receptacle of the different associated ones of the four feet; four vertical posts, each of the four vertical posts being configured to be removably received within the third receptacle of a different associated one of the four feet; and four top rails, each of the four top rails being configured to be coupled between different associated ones of the four vertical posts.

In accordance with yet another aspect of the disclosure there is provided a portable crib including: four feet, each of the four feet including a first receptacle, a second receptacle, a third receptacle, and a fourth receptacle, the first, second and third receptacles being arranged adjacent different associated corners thereof to provide a first space between the first receptacle and the third receptacle and a second space between the second receptacle and the third receptacle; four side rails, each of the four side rails including a straight portion and first and second angled ends positioned at substantially a right angle to the straight portion, the first and second angled ends configured to extend downwardly into the first receptacle or the second receptacle of different associated ones of the four feet to allow each of the four side rails to be removably received in the different associated ones of the four feet by inserting the first and second angle ends downwardly and into the first receptacle or the second receptacle of the different associated ones of the four feet; four vertical posts, each of the four vertical posts configured to be removably received within the third receptacle of a different associated one of the four feet; four top rails, each of the four top rails including a first top rail member pivotally coupled to a second top rail member and each of the four top rails configured to be coupled between different associated ones of the four vertical posts; four bottom rail members, each of the bottom rail members having a first end configured to be removably received in the fourth receptacle of a different associated one of the four feet; a hub, each of the bottom rail members having a second end configured to be coupled to the hub; and first and second support legs, each of the first and second support legs including a first end coupled to the hub and a second end configured to contacting a floor surface.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems. The term "coupled" as used herein refers to any connection, coupling, link, or the like by which signals carried by one system element are imparted to the "coupled" element. Such "coupled" devices, or signals and devices, are not necessarily directly connected to one another and may be separated by intermediate components or devices that may manipulate or modify such signals. Likewise, the terms "connected" or "coupled" as used herein in regard to mechanical or physical connections or couplings is a relative term and does not require a direct physical connection. Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements. The phrase "at least one of A and B" should be understood to mean "only A, only B, or both A and B."

Spatially relative terms, such as "beneath," below," upper," "lower," "above", "left", "right" and the like may be used herein for ease of description to describe one element or feature's relationship to another element(s) or feature(s) as illustrated in the drawings. These spatially relative terms are intended to encompass different orientations of the device in use or operation in addition to the orientation shown in the drawings. For example, if the device in the drawings is turned over, elements described as "below" or "beneath" other elements or features would then be oriented "above" the other elements or features. Thus, the exemplary term "below" may encompass both an orientation of above and below. The device may be otherwise oriented (rotated 90 degrees or at other orientations) and the spatially relative descriptors used herein interpreted accordingly.

Although the terms "first," "second," "third" etc. may be used to describe various elements, components, regions, layers and/or sections, these elements, components, regions, layers and/or sections are not to be limited by these terms as they are used only to distinguish one element, component, region, layer or section from another element, component, region, layer or section. Thus, a first element, component, region, layer, or section could be termed a second element, component, region, layer, or section without departing from the scope and teachings of the present invention.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. It will be appreciated by a person skilled in the art that a crib consistent with the present disclosure may embody any one or more of the features contained herein and that the features may be used in any particular combination or sub-combination. Modifications and substitutions by one of ordinary skill in the art are considered to be within the scope of the present disclosure, which is not to be limited except by the claims.

What is claimed is:

1. A portable crib comprising:

four feet, each of the four feet comprising an associated base defining a first receptacle, a second receptacle and a third receptacle, the first, second and third receptacles being arranged adjacent different associated corners of the associated base, wherein each of the first, second, and third receptacles is closer to its associated corner than to any other corner of the associated base;

four side rails, each of the four side rails comprising a straight portion and first and second angled ends positioned at an angle to the straight portion, the first and second angled ends configured to extend downwardly into the first receptacle or the second receptacle of different associated ones of the four feet to allow each of the four side rails to be removably received in the different associated ones of the four feet by inserting the first and second angle ends downwardly and into the first receptacle or the second receptacle of the different associated ones of the four feet;

four vertical posts, each of the four vertical posts being configured to be removably received within the third receptacle of a different associated one of the four feet; and four top rails, each of the four top rails being configured to be coupled between different associated ones of the four vertical posts.

2. The portable crib of claim 1, wherein the entirety of each of the first receptacle, the second receptacle, and the third receptacle is within a different associated quadrant of the associated base, each different associated quadrant being defined by the intersection of a first centerline C1 and a second centerline C2 of the associated base, each of the first centerline C1 and the second centerline C2 extending through a center point of the associated base and perpendicularly to an associated side of the associated base, and wherein the associated corner of each of the first receptacle, the second receptacle, and the third receptacle is located within the same associated quadrant as the respective receptacle.

3. The portable crib of claim 1, wherein a first space is provided between the first receptacle and the third receptacle and a second space is provided between the second receptacle and the third receptacle.

4. The portable crib of claim 3, wherein the first and second spaces are greater than or equal to 0.5 inches.

5. The portable crib of claim 1, wherein the associated base of each of the four feet further defines a fourth receptacle and the portable crib further comprises four bottom rail members, each of the bottom rail members having a first end configured to be removably received in the fourth receptacle of a different associated one of the four feet.

6. The portable crib of claim 5, further comprising a hub, and wherein each of the bottom rail members comprises a second end configured to be coupled to the hub.

7. The portable crib of claim 6, further comprising first and second support legs, each of the first and second support legs comprising a first end coupled to the hub; an angled portion coupled to the first end and extending from the first end at a non-zero angle to the first end, an extension coupled to the angled portion, and a second end coupled to the angled portion and extending downwardly for contacting a floor surface.

8. The portable crib of claim 1, wherein the angle is substantially a right angle.

9. The portable crib of claim 1, wherein each of the four top rails comprises a first top rail member pivotally coupled to a second top rail member.

10. The portable crib of claim 1, wherein at least a portion of the portable crib is configured to fold in order to transition from an in-use configuration to a storage configuration.

11. The portable crib of claim 1, wherein each of the four feet has a parallelogram-shaped cross-section.

12. A portable crib comprising:

four feet, each of the four feet comprising an associated base defining a first receptacle, a second receptacle, a third receptacle, and a fourth receptacle, the first, second and third receptacles being arranged adjacent different associated corners of the associated base, wherein each of the first, second, and third receptacles is closer to its associated corner than to any other corner of the associated base, and wherein the arrangement of the first, second, and third receptacles adjacent different associated corners of the associated base provides a first space between the first receptacle and the third receptacle and a second space between the second receptacle and the third receptacle;

four side rails, each of the four side rails comprising a straight portion and first and second angled ends positioned at substantially a right angle to the straight portion, the first and second angled ends configured to extend downwardly into the first receptacle or the second receptacle of different associated ones of the four feet to allow each of the four side rails to be removably received in the different associated ones of the four feet by inserting the first and second angle ends downwardly and into the first receptacle or the second receptacle of the different associated ones of the four feet;

four vertical posts, each of the four vertical posts configured to be removably received within the third receptacle of a different associated one of the four feet;

four top rails, each of the four top rails comprising a first top rail member pivotally coupled to a second top rail member and each of the four top rails configured to be coupled between different associated ones of the four vertical posts;

four bottom rail members, each of the bottom rail members having a first end configured to be removably received in the fourth receptacle of a different associated one of the four feet;

a hub, each of the bottom rail members having a second end configured to be coupled to the hub; and first and second support legs, each of the first and second support legs comprising a first end coupled to the hub and a second end configured to contacting a floor surface.

13. The portable crib of claim 12, wherein the entirety of each of the first receptacle, the second receptacle, and the third receptacle is within a different associated quadrant of the associated base, each different associated quadrant being defined by the intersection of a first centerline C1 and a second centerline C2 of the associated base, each of the first centerline C1 and the second centerline C2 extending through a center point of the associated base and perpendicularly to an associated side of the associated base, and wherein the associated corner of each of the first receptacle, the second receptacle, and the third receptacle is located within the same associated quadrant as the respective receptacle.

14. The portable crib of claim 12, wherein the first space is measured between nearest points of the first receptacle and the third receptacle and the second space is measured between nearest points of the second receptacle and the third receptacle, and wherein the first and second spaces are greater than or equal to 0.5 inches.

15. The portable crib of claim 12, wherein each of the first and second support legs comprises a first end coupled to the hub; an angled portion coupled to the first end and extending from the first end at a non-zero angle to the first end, an extension coupled to the angled portion, and a second end coupled to the angled portion and extending downwardly for contacting a floor surface.

16. The portable crib of claim 12, wherein each of the four feet has a parallelogram-shaped cross-section.

17. The portable crib of claim 12, wherein at least a portion of the portable crib is configured to fold in order to transition from an in-use configuration to a storage configuration.

18. The portable crib of claim 5, wherein the fourth receptacle is defined by first and second spaced upwardly extending walls and a top surface of a shelf defined by the associated base, the fourth receptacle having an open end adjacent a fourth corner of the associated base.

19. The portable crib of claim 18, wherein a bottom of the fourth receptacle opens into an interior cavity defined by the associated base.

20. The portable crib of claim 1, wherein each of the first and second angled ends is removably coupled to the associated receptacle by a spring biased pin.

* * * * *